United States Patent [19]

Hammarqvist

[11] 4,091,941

[45] May 30, 1978

[54] INGOT MOULD HANDLING MEANS

[75] Inventor: Bo Georg Hammarqvist, Norberg, Sweden

[73] Assignee: AB Norbergs Mekaniska Verkstad, Norberg, Sweden

[21] Appl. No.: 678,749

[22] Filed: Apr. 21, 1976

[30] Foreign Application Priority Data

Apr. 21, 1975 Sweden ..... 75045807

[51] Int. Cl.[2] ..... B60P 1/52; B60P 1/64

[52] U.S. Cl. ..... 214/38 D; 198/741; 214/83.3; 214/84; 214/516

[58] Field of Search ..... 214/18 R, 23, 26, 38 B, 214/38 BA, 38 BB, 38 D, 516, 83.14, 84; 198/621, 741; 104/48, 162

[56] References Cited

U.S. PATENT DOCUMENTS

| | | | |
|---|---|---|---|
| 2,168,527 | 8/1939 | Iversen | 214/26 |
| 3,677,423 | 7/1972 | Tollefsrud et al. | 214/83.14 X |
| 3,891,096 | 6/1975 | Terada | 198/741 |

*Primary Examiner*—Robert G. Sheridan

*Attorney, Agent, or Firm*—Finnegan, Henderson, Farabow & Garrett

[57] ABSTRACT

An apparatus for handling moulds or ingot moulds prior to and after casting or teeming, such as transfer between knocking-out stripping, preparing, forming and casting or teeming stations, the moulds or ingot moulds being brought together into a casting or teeming unit containing a plurality of moulds or ingot moulds, the casting or teeming unit being transferred between the various stations on a car. The casting or teeming units at the various stations are pushed off the car over onto a station or are pulled over onto the car from the station by means of pushing and pulling device which constitute part of the car.

9 Claims, 6 Drawing Figures

INGOT MOULD HANDLING MEANS

Figure 1:
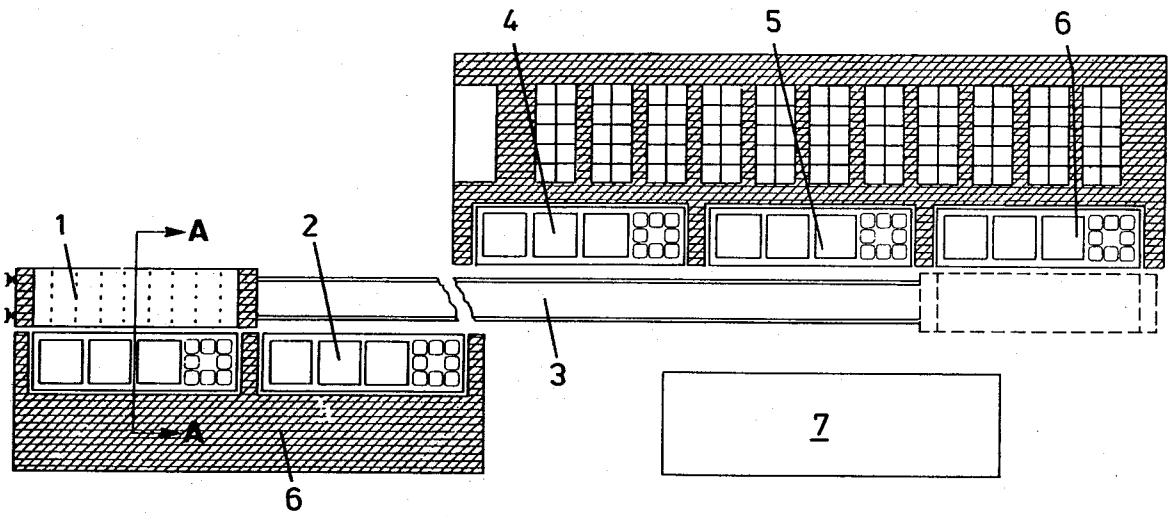

In the foundary field and in the handling of steel the transfer of moulds and ingot moulds has always been a troublesome problem, whether in terms of preparing, filling with molten metal, knocking-out or preparing anew. The handling of the moulds and ingot moulds has usually required the utilization of an overhead crane with an operator and at least two men on the work floor.

Through the arrangement of stations attempts have been made to better organize the flow of material through the plant. Thus, a casting or teeming station, a knocking-out or stripping station, a preparation station and, as required, several of any one station depending on how quickly the operation at each station normally runs have been provided, by way of example.

The transfer and handling between stations of the moulds or casting moulds has always been labor-demanding and thereby costly. Overhead cranes or track-bound cars or a combination thereof have for example been used. The cars have had small load capacity and thus a large number has been required. The overhead cranes have had limited capacity, particularly with respect to time. Ideally it should be possible to handle, transfer and knock-out an entire charge in moulds or ingot moulds after casting or teeming from a smelting or refining furnace.

With the method and means according to the invention it is possible to facilitate the handling of moulds or ingot moulds in all stages of the production process, i.e. in the teeming zone of the furnace plant and also for increasing the capacity of existing plants. The crane for ladles is thereby freed from work with moulds and ingot moulds and waiting time is reduced.

The invention is related to a method for handling moulds or ingot moulds prior to and after casting or teeming such as transfer between knocking-out, stripping, preparing, forming and casting or teeming stations, whereby the moulds or ingot moulds are brought together as a casting or teeming unit containing a plurality of moulds or ingot moulds. The casting or teeming units are conveyed between the various stations on a car and the method is characterized in that the units at the various stations are pushed off of the car over onto the station or are pulled over onto the car from the station by means of pushing and pulling means which constitute part of the car.

In conveying the casting or teeming units onto the car, said units are locked onto the car by means of the pushing and pulling means.

When the casting or teeming unit is displaced off or pulled onto the car, this may be performed step by step.

Means for carrying out the method of the invention for handling moulds or ingot moulds prior to and after casting or teeming, such as transfer between knocking-out, stripping, preparing, forming and casting or teeming stations wherein the moulds or ingot moulds are brought together as casting or teeming units in which teeming unit comprises a plurality of moulds or ingot moulds comprise a travelling car disposed between the fixed stations and adapted to receive the casting or teeming units, the fixed stations and the car having roller-equipped beds on which the casting or teeming units are to rest and the means is characterized in that the car is furnished, preferably at its two ends, with displacement and pulling means adapted to push the casting or teeming unit at the stations over onto the station bed or to pull the casting or teeming unit onto the car bed from the station bed.

According to the invention the pushing and pulling means consist of an arm at each end of the car powered by a common drive source.

Each of the arms is furnished with at least one individually operable plunger adapted to fit into at least one socket in the base of the casting or teeming unit.

According to one embodiment of the invention, each arm is furnished with a plunger and the base of the casting or teeming unit is furnished with three sockets into which the arm plunger can be inserted.

According to another embodiment of the invention, each arm is furnished with a plurality of plungers and the base of the casting or teeming units is furnished with three sockets into which the plungers can be optionally inserted. According to a particular embodiment of the invention, each arm is furnished with three plungers and the casting or teeming unit with three sockets into which the plungers can be optionally inserted.

According to the invention, the mutual spacing of the plungers differs from the mutual spacing of the sockets on the casting or teeming unit.

Since according to one embodiment of the invention three plungers are disposed on each arm, in one embodiment of the invention the middle plunger on each arm is disposed opposite the middle socket on the base of the casting or teeming unit.

Moreover, in accordance with a further embodiment of the invention, the mutual spacing of the plungers is greater than the mutual spacing of the socket on the casting or teeming unit.

The plungers on the arms are movable in a direction substantially perpendicular to the motion of the pushing and pulling means into the sockets which are disposed on the short side of the casting and teeming unit.

In one embodiment of the invention the plungers and the sockets are conically shaped.

In the invention the car, the pushing and pulling means arms and the plungers all are furnished with hydraulic driving devices.

The invention will be described in detail in connection with one example of the invention describing ingot mould handling in a steel mill and illustrated in the attached drawings.

Figure 2:
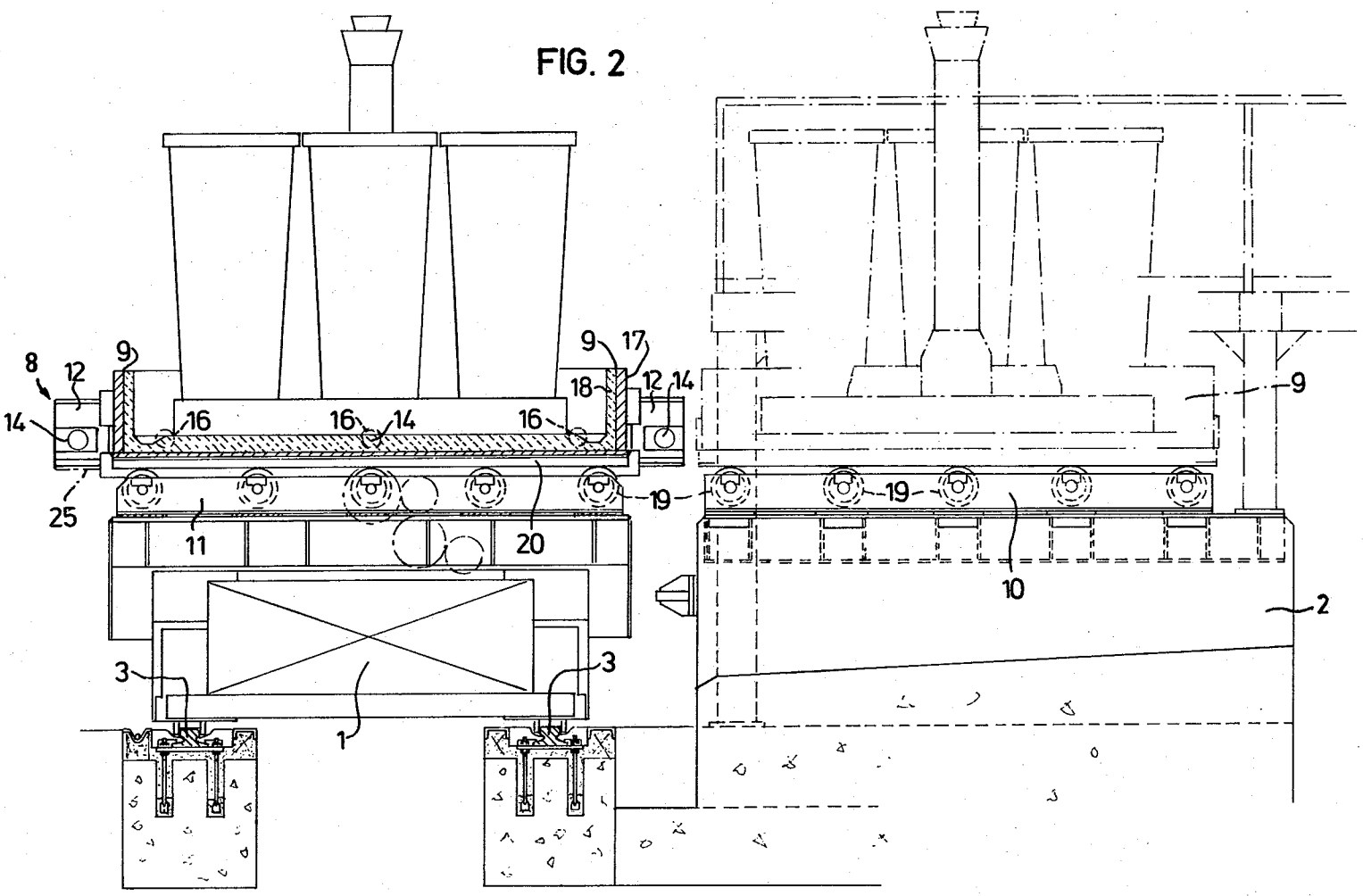
Figure 3:
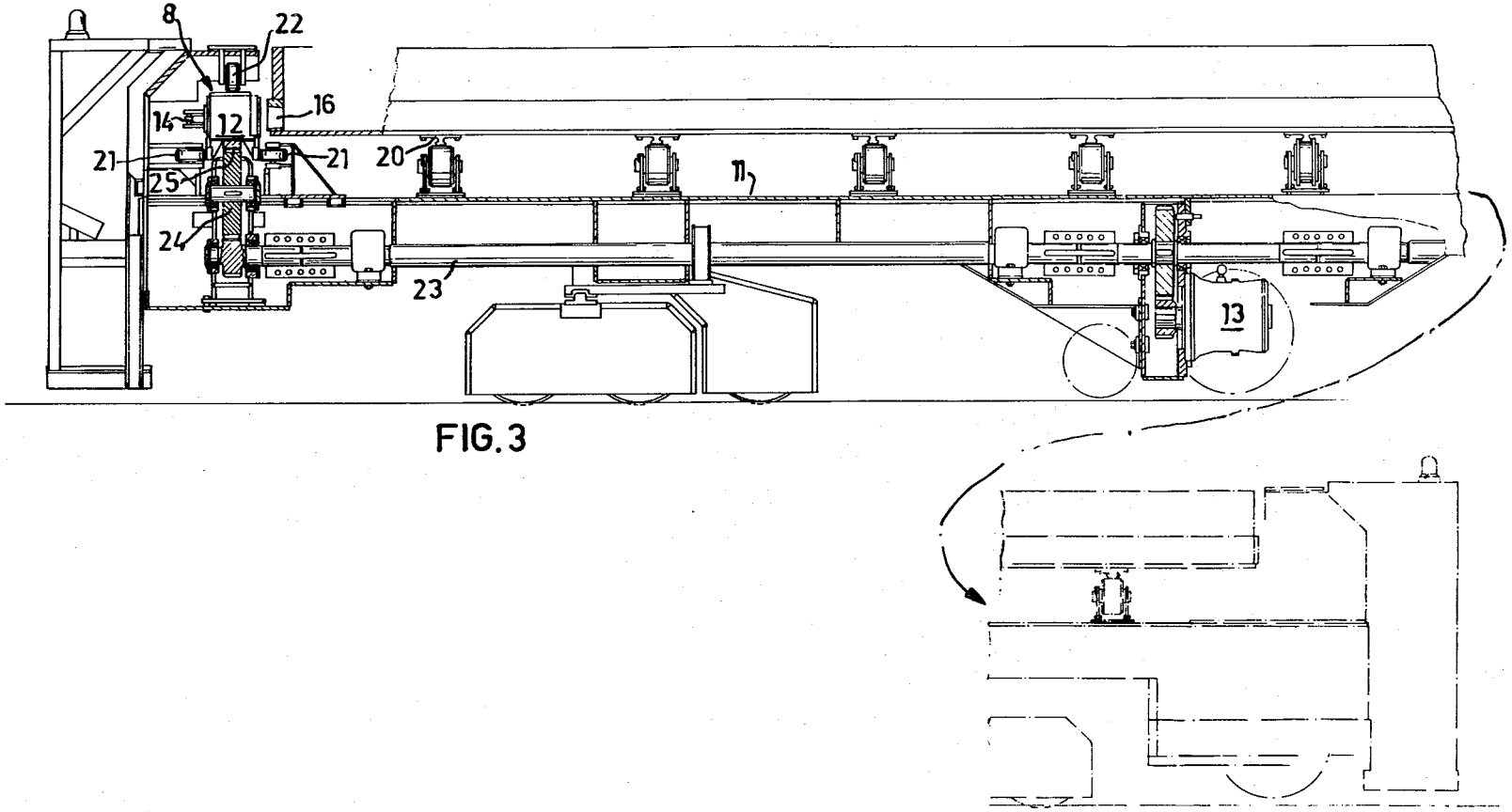
Figure 4:
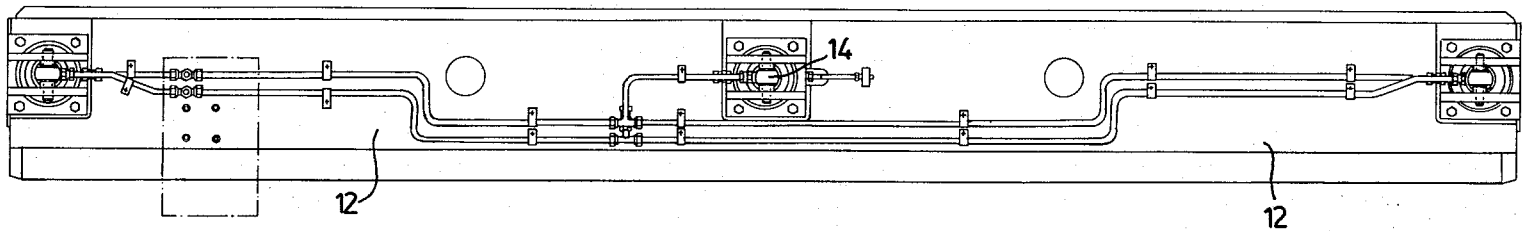
Figure 5:
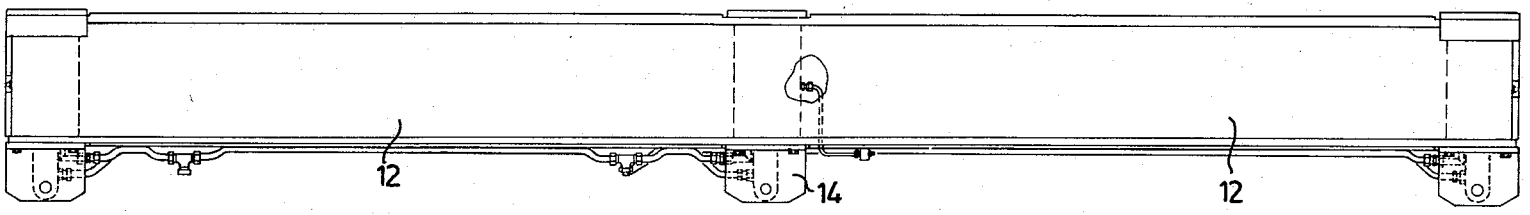
Figure 6:
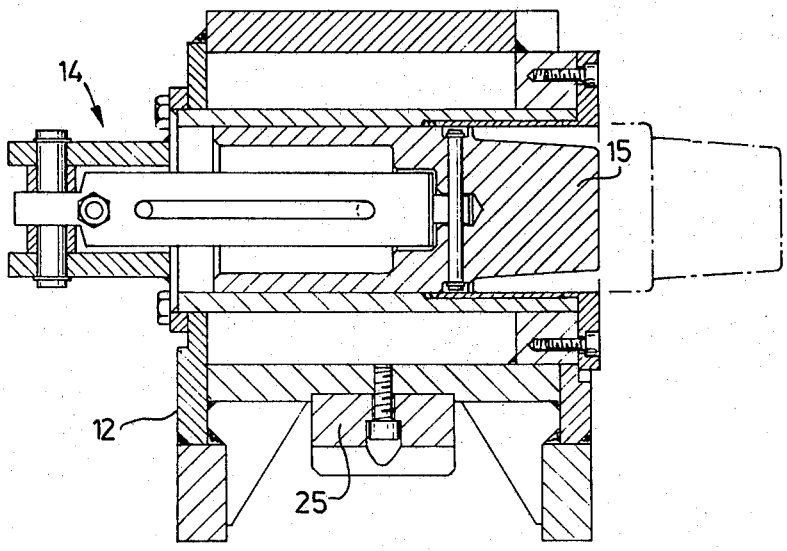

FIG. 1 show one possible arrangement of a teeming bay,

FIG. 2 a schematic section through a casting or teeming station of a device where use is made according to the invention and taken generally along the line A—A of FIG. 1, FIG. 3 a side elevation of a device according to the invention, FIG. 4 a side elevation of a displacement and pulling arm, FIG. 5 a view of the displacement and pulling arm of FIG. 4 seen from above, and finally FIG. 6 shows a detail view of a plunger device.

In FIG. 1, which schematically shows a plan of one possible arrangement in a teeming bay, 1 designates a car which in the example is track-bound, 2 a teeming station, 3 tracks for the car 1, 4 a stripping station, 5 a cooling station and a preparation station, 6 a working platform and 7 place for baseplate preparation. The example shows the handling of ingot moulds in connection with uphill teeming, but could of course apply as well to downhill teeming.

Depending on the charge capacity of the smelting or refining units, a number of baseplates are brought together with a sufficient number of ingot moulds to receive an entire smelt charge (entire heat) at the teeming station 2. The ingot moulds with their baseplates are arranged in a casting on teeming unit 9, consisting in principle of a trough 17 line with refractory material 18 to absorb any overflow and splash in teeming the molten metal into the ingot moulds. The teeming unit 9 is transported by means of the car 1 between the various stations and is pushed for example at the teeming station 2 off the car onto the station by means of transfer or pushing and pulling means 8, the transfer between car and station taking place step by step or in one single stroke by the pushing means. Both the car 1 and the various stations are furnished with beds consisting of rollers 19 arranged in adjacent rows into a bed 10 for the stations and a bed 11 on the car. The beds on the car and on the stations are identical. The trough 17 of the teeming unit 9 is furnished on its underside with rails 20 or the like adapted to roll on the rollers 19 in the beds 10, 11.

FIG. 2 shows a schematic cross-section through a teeming station 2 and a car 1 opposite said station with a teeming unit 9 on the car. The dashed line to the right in the figure shows the position of the teeming unit after it has been transferred from the car 1 to the station 2. The car 1 which travels on track 3 is adapted to receive a casting or teeming unit 9 on its upper part on the bed disposed there which is furnished with rollers 19. At each short side of the car there are pushing and pulling means 8 for the teeming unit 9. The pushing and pulling means 8 (FIG. 3) consist of arms 12 with accompanying guide and power means. The arms 12 are guided by means of horizontally disposed guide rollers 21 and vertically disposed guide rollers 22, the vertically disposed being adapted to run on the upper side of the arm 12 and the horizontally disposed against specially adapted ways (FIG. 3) on the lower portion of the arm. The arms are powered from a power source 13 centrally mounted on the car such as a hydraulic motor which via a shaft 23 drives a gear wheel 24 which engages a rack 25 attached to the lower side of the arm 12 (FIG. 3). The pushing and pulling arm 12 is further furnished with at least one plunger device 14 with plunger 15 adapted to be inserted into an optional socket 16 disposed on the base of the teeming unit 9.

The car 1 consists of a bogie arrangement with 12 wheels and a car chassis resting thereon. In this example the car is driven hydrostatically by a conventional pump tank unit placed on the car and providing hydraulic pressure to conventional hydraulic motors in the bogie or bogies, which motors drive the desired number of wheels.

The pump tank unit is driven by an electric motor which receives current via a cable which is rolled out after the car 1. The cable is rolled up onto a conventional cable drum under one end of the car, the drum being conveniently driven by an electric motor via a hydraulic coupling.

Power transmission to the car wheels takes place in the same way as to the displacement and pulling arms 12. Connected to the car 1 wheel undercarriage are two rotating brushes for brushing the cable track clean for laying down the cable. The car can be controlled from operator positions at either end of the car from which the functions of the displacement and pulling arm 12 also is controlled.

There may also be two lock cylinders on the car rack which aid the operator to locate and lock the car opposite a station. The cylinders are operated from the operator compartment and are controlled by conventional limit switches which give an impulse to signal lamps in the operator compartment.

The pushing and pulling arm 12 is also adapted in its extended end positions to actuate conventional limit switches whose functions is to prevent the arm from being extended too far by an interruption of the drive of the shaft 23 when the arm 12 actuates one of the limit switches. So that the operator will know when the arms 12 are in their middle position, there are also limit indicators which send a signal to the operator compartment in such a case. The operator can then lock the casting and teeming unit to the car with the middle plunger device 14 on the arm 12 so that its plunger 15 is inserted into the middle socket 16 on the casting and teeming unit 9. When the operator receives the signal that the arms 12 are in their middle position and the teeming unit 9 is locked by means of the middle plunger device 14 and also that the two locking cylinders for fixation of the car opposite a station are free, the operator can drive the car to another station.

The working method of the device according to the invention is as follows:

An empty car 1 moves up to station 5 and collects a casting or teeming unit, in the present case a teeming unit 9 having four baseplates with ingot moulds ready for teeming. The car is moved up to the teeming station 2 where by means of the pushing and pulling arms 12 the casting and teeming unit 9 is pushed off of the bed 11 of the car 1 over onto the bed 10 of the teeming station 2 by manouvering the plunger device 14 so that its plunger 15 (FIG. 6) is inserted into the middle socket 16 on the teeming unit 9 base and thereafter manouvering the arm via the shaft 23 and the gear wheel 24 so that it moves the teeming unit 9 laterally on the rollers 19 off of the car 1 over onto the rollers 19 in the teeming station bed 10. There is, however, a limit to how far the arm 12 can be extended from the car and it is therefore suitable to extend the arm to half its length from the car and thereafter retract the plunger 15 into the plunger device 14 and move the arm back over to the car so that the plunger device 14 is opposite the next socket 16 on the base of the teeming unit 9 and thereafter allow the arm to repeat the movement so that the teeming unit 9 will rest entirely on the bed 10 of the teeming station 2.

In the example shown, FIGS. 4 and 5, each arm 12 is shown with three plunger devices 14 which offers additional possibilities for step by step or one step transfer of the teeming unit 9 from the car to the station or the station to the car. It is, however, important that the mutual spacing of the indentations 16 on the teeming unit base be lesser than the mutual spacing of the plunger devices 14 on the arm 12.

After the teeming unit 9 has been left at the teeming station, the car is moved to another teeming station and there collects a teeming unit 9 with ingot moulds in which teeming has already taken place and transfers this teeming unit to a cooling and preparing station 5 where it is allowed to cool and subsequently is prepared again for receiving a new whole charge after transfer to a teeming station 2, and thereafter the sequence is repeated. When transferring a teeming unit on the car the teeming unit may of course be locked to the car by a separate locking unit separate from the pushing and pulling means whereby e.g. a plunger may be arranged on the car to lock a teeming unit with the aid of a socket arranged on the underside of the teeming unit.

A bed 10 or 11 for a station or for the car consists of 8 rows of rollers, 40 rollers in all per station. In a plant with 6 stations there are thus 240 rollers.

By way of example a practical embodiment of a car has the following technical data:

Total length: 14,240 mm
Width: 3,200 mm
Width including pushing and pulling arms: 3,800 mm
Track width: 2,200 mm
Rails, crane rails, width: 120 mm
Weight, car chassis: 43 tons
Bogies: 10 tons
Casting and teeming unit: 12 tons
Car total without load: 65 tons
Max. distributed load: 260 tons The system described herein for handling moulds or ingot moulds is built around a self-propelling car which operates either longitudinally or transversely in the teeming bay. The teeming unit rests on the car and can be moved transversely in relation to the car and is pushed off of or pulled onto the car by the arms 12, hydraulically operated in this example. A suitable number of teeming stations should be disposed in front of the furnace or furnances and after the teeming, the car collects the teeming unit with ingot moulds and ingots and transfers them to one of the stripping stations 4 where stripping and preparing of a new teeming unit takes place. In this way the handling of the ingot moulds in the teeming and stripping preparing zones is kept entirely separate. The number of stations in the two zones depends of course on the number of furnaces which are to be included in the handling system.

When the car 1 goes between the zones, the car conveys ingots in one direction and prepared ingot moulds or moulds in the other.

As one skilled in the art can well appreciate, a number of modifications can be made in the system described herein without deviating from the inventive conception.

What I claim is:

1. Apparatus for transferring a teeming unit, adapted to hold a plurality of moulds and including a base plate, between a plurality of working stations comprising a car adapted to travel along a predetermined path, said stations being arranged on opposite sides of the path in spaced parallel relation, fixed beds of rollers mounted on the car and at the various stations at identical elevations for movably supporting the base plate of the teeming unit, transfer means mounted on the car for selectively engaging the base plate of the unit to laterally transfer the unit along the roller beds between the car and stations on either side of the car, said transfer means comprising a horizontal arm mounted at each end of the car for lateral movement with respect to the direction of travel of the car, at least one operable plunger mounted on each arm and at least one cooperating socket for receiving each plunger located in the base plate of the unit, and means for actuating the plungers and the arm to laterally transfer the unit between the car and a station.

2. The apparatus of claim 1 wherein said at least one plunger engages said at least one cooperating socket and locks the unit to the car during travel thereof between stations.

3. The apparatus of claim 1 which includes spaced parallel rails defining said predetermined path, said car being constructed to travel along said spaced parallel rails.

4. The apparatus of claim 1, in which the base plate has a plurality of sockets for optionally receiving each plunger.

5. The apparatus of claim 4, in which each arm is provided with a plurality of plungers cooperating with the plurality of sockets in the base plate.

6. The apparatus of claim 5, in which each arm has three plungers and each unit has three cooperating sockets in its base plate for optionally receiving each of the plungers.

7. The apparatus of claim 6, in which the spacing of the plungers on the arms differs from the spacing of the cooperating sockets on the base plate of the teeming unit.

8. The apparatus of claim 7, in which the middle plunger of the three plungers on each arm when the unit is located on the car is disposed opposite the middle socket in the base plate of the unit.

9. The apparatus of claim 8, in which the spacing between the plungers on each arm is greater than the spacing between the sockets on the base plate of the unit.

* * * * *